US007934459B2

(12) United States Patent
Frazier

(10) Patent No.: US 7,934,459 B2
(45) Date of Patent: May 3, 2011

(54) ERGONOMIC WORKSTATION WITH RAISING AND LOWERING ELEMENTS

(76) Inventor: Brian Frazier, Clayton, NC (US)

( * ) Notice: Subject to any disclaimer, the term of this patent is extended or adjusted under 35 U.S.C. 154(b) by 572 days.

(21) Appl. No.: 11/523,356

(22) Filed: Sep. 19, 2006

(65) Prior Publication Data

US 2007/0068429 A1 Mar. 29, 2007

Related U.S. Application Data

(60) Provisional application No. 60/718,798, filed on Sep. 20, 2005.

(51) Int. Cl.
*A47B 9/00* (2006.01)

(52) U.S. Cl. ..... 108/64; 108/147

(58) Field of Classification Search ..... 108/147, 108/144.11, 50.01, 50.02, 106, 65, 96, 147.19, 108/12, 19; 248/188, 188.1, 188.8, 188.5, 248/188.2; 312/223.3, 107, 108, 111, 194, 312/195

See application file for complete search history.

(56) References Cited

U.S. PATENT DOCUMENTS 2,556,943 A * 6/1951 Reisman ..... 108/90
2,585,111 A * 2/1952 Grauer ..... 108/69
2,909,400 A * 10/1959 Johnston et al. ..... 248/172
3,217,672 A * 11/1965 Haughey ..... 108/146
3,339,503 A * 9/1967 Flodell ..... 108/158
3,460,488 A * 8/1969 Hoerner ..... 108/144.11
3,554,142 A * 1/1971 Sorenson et al. ..... 108/157.13
3,964,401 A * 6/1976 Gutmann et al. ..... 108/64
5,443,017 A * 8/1995 Wacker et al. ..... 108/3
5,483,898 A * 1/1996 Seidl ..... 108/3
5,490,466 A * 2/1996 Diffrient ..... 108/96
5,718,179 A * 2/1998 Johnson et al. ..... 108/50.02
5,819,671 A * 10/1998 Ocampo ..... 108/64
5,943,965 A * 8/1999 Riach et al. ..... 108/36
6,101,954 A * 8/2000 Rein et al. ..... 108/50.02
6,135,032 A * 10/2000 Ko ..... 108/96
6,158,295 A 12/2000 Nielsen
6,161,487 A * 12/2000 Chang ..... 108/50.01
6,196,140 B1 * 3/2001 Newhouse et al. ..... 108/50.01
6,336,618 B1 1/2002 Barber
6,490,981 B2 * 12/2002 Isensee et al. ..... 108/50.02
6,726,168 B2 4/2004 Barber
6,739,004 B1 5/2004 Abrahamsen
6,770,006 B2 8/2004 Abrahamsen
6,997,114 B2 * 2/2006 Chang ..... 108/64
7,047,834 B2 5/2006 Nielsen
7,066,041 B2 6/2006 Nielsen
7,111,564 B2 * 9/2006 Chang ..... 108/155
7,357,086 B2 * 4/2008 Petrick et al. ..... 108/50.02

(Continued)

*Primary Examiner* — Janet M Wilkens
(74) *Attorney, Agent, or Firm* — Womble Carlyle Sandridge & Rice, PLLC

(57) ABSTRACT

Ergonomic workstations include devices with raising and lowering elements, such as tables and desks. The devices include one or more legs, and when more than one leg is present, each leg is substantially parallel to the other legs. Each leg is provided with a base for attaching the leg to another or to multiple other legs. The devices further include one or more sub-surfaces for connecting one or more of the legs and one or more top surfaces. The substructure is provided with more than one arrangement of hole patterns for attaching the top surface and/or the legs. In some aspects, the devices include two top surfaces which are raised or lowered by actuators in the legs. The plurality of legs can either maintain the second top surface at a constant height, or can raise and lower the second top surface independent of the first top surface.

10 Claims, 9 Drawing Sheets

U.S. PATENT DOCUMENTS 7,469,642 B1 * 12/2008 LeDoux ..... 108/12
2005/0150437 A1 * 7/2005 Chen ..... 108/147
2005/0217540 A1 * 10/2005 Novak ..... 108/50.01
2005/0217542 A1 * 10/2005 Tzeng ..... 108/157.1
2006/0260515 A1 * 11/2006 Hodges et al. ..... 108/6
2008/0289545 A1 * 11/2008 Picchio ..... 108/106

* cited by examiner

ERGONOMIC WORKSTATION WITH RAISING AND LOWERING ELEMENTS

RELATED APPLICATION

This application claims benefit of U.S. Provisional Patent Application No. 60/718,798, filed Sep. 20, 2005, the contents of which are fully incorporated herein by reference.

FIELD OF THE INVENTION

The invention is generally in the area of ergonomic furniture, and, more specifically, in the area of furniture which includes an element that is capable of raising and lowering as needed.

BACKGROUND OF THE INVENTION

As the workforce ages, needs arise to provide more work surface adjustability for the operator, helping to reduce repetitive strain injuries. In an office environment, there are several styles of furniture designed to provide a level of ergonomic value to the operator. Studies have shown a need to fine tune the position of the furniture in relation to the operator. For example, there is occasionally a need for a user to sit or stand at their work surface, to reduce the static load on the lumbar region of their backs. There is also an occasional need to adjust the viewing position of the monitor. For example, one can lower the monitor to a point below the work surface, which allows a user with corrected vision to view the monitor in a neutral posture, thus relieving static load on the neck.

One example of a means for raising and lowering the desk height is a column manufactured by Linak US. Linak's electric column enables a work surface to be lifted from a sitting to a standing height. Linak does not provide a desktop surface, or any other surface, to attach to the columns, so the columns are typically used with a furniture manufacturer's proprietary top surface. Such top surfaces are engineered to attach directly to the columns and maintain them in substantially parallel orientation.

After the furniture manufacturer has attached a top surface directly to one or more Linak columns, it is very difficult to modify the top surface without disrupting the parallel nature of the columns. That is, if an end user wishes to use its own top surface (such as a desk top), one runs the risk of altering the substantially parallel nature of the columns, and causing the columns to bind when raised or lowered. This makes custom fitting for individual operators extremely difficult. Thus, a limitation in the art is the ability to provide multiple or differently configured work surfaces to accommodate the user's work needs.

There remains a need for a modular designed sub-frame that will allow multiple configurations of work surfaces, while keeping single or multiple columns that have the ability to raise or lower a work station in parallel orientation. It would be advantageous to provide a means for maintaining the actuator legs in parallel while permitting flexibility in the selection of the attached top surface. The present invention provides such flexibility.

It would also be advantageous to provide the ability to raise and lower a monitor, for example, with a cantilevered arm, while also providing the ability to raise and lower the height of the remainder of a desktop. The present invention provides such devices with such ability.

SUMMARY OF THE INVENTION

Devices with raising and lowering elements, such as tables and desks, are disclosed. The devices include a plurality of legs, ideally with each leg substantially parallel to the other (s). Each leg includes a top end and bottom end. The bottom end of each leg is, independently, either provided with a base, or with a means for attaching the leg to another or to multiple other legs, for example, to provide structural integrity to the device. The base can be flat, or can include rollers or other such means for moving the device.

The devices further include one or more sub-surfaces for connecting all or a portion of the plurality of legs, provided that each leg is attached to a subsurface at or near its top end. The subsurfaces each include a means for attaching to the top end (or near the top end) of the legs, and also a means for attaching to a top surface. Examples of means for attaching the subsurface to the legs include screws, including machine screws, bolts, nuts, and the like. Thus, the legs can be attached to one or more top surfaces.

In still another aspect, the substructure is provided with more than one arrangement of pre-drilled hole patterns for attaching the top surface and/or the legs, so that one substructure can be used to permit the option of attaching different top surfaces or different leg orientations. For example, this can be used to provide both a right handed or left handed arrangement of desktop surfaces, and thus, individually tailor a workstation to the individual's needs.

The top surface(s) can include, for example, table tops, padded tops, for example, for use in supporting and/or transporting patients, desk tops, and the like.

In one aspect, two or more of the legs are capable of being raised and lowered in series, such that an attached top surface can be raised or lowered. Two or more such top surfaces can be raised and lowered to different heights, which can provide advantages in certain applications. For example, when used as a desk, a keyboard and/or mouse can be provided at a certain height, and a monitor at another height, to provide the user(s) with a custom fit, ergonomically correct workspace.

Using the various aspects of the invention, ergonomic workstations can be created, which can raise and lower various portions of a desktop to provide a custom fit, ergonomically correct workstation. The configurations are not limited to any given shape, but rather, by judicious positioning of the various legs using various hole patterns in the substructure, can be formed into any desired configuration. Representative configurations include square, triangular, circular, elliptical, trapezoidal, and L-shaped configurations.

The invention will be better understood with reference to the following detailed description of the invention.

DETAILED DESCRIPTION OF THE INVENTION

Figure 1:
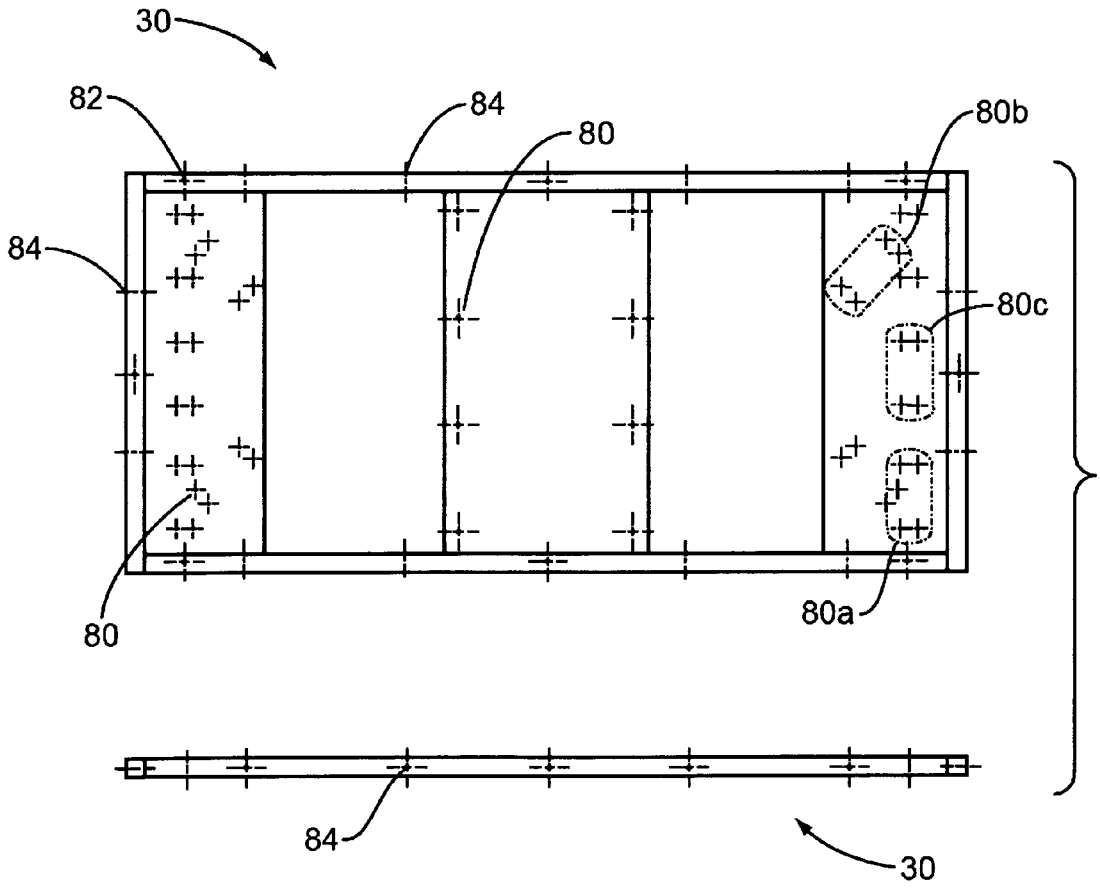
FIG. 1 is a schematic illustration of a sub-surface (or table frame) 30 as described herein. The plus signs (+) represent holes 80 for attaching the sub-surface 30 to both the top surface(s) and to the legs (actuators) (not shown). As shown in the figure, more holes 80 are present than are required for attaching the legs or the table top, so that the legs and/or top can be provided in various configurations, and the same subsurface 30 can be used to attach multiple top surfaces and accommodate multiple leg configurations.

Devices with raising and lowering elements, such as tables and desks, are disclosed. The devices include one or more legs 20, and when they include more than one leg 20, each leg 20 is substantially parallel to the other(s). As shown in FIGS. 2-8, the bottom ends of the legs 20 are attached to one or more bases 70, 72 and 74, and the top ends of the legs 20 are attached to one or more sub-surfaces 30, 32, 130, 132, 134, 230 or 234. As also shown in FIGS. 2-8, the sub-surfaces 30, 32, 130, 132, 134, 230 and 234 are attached to top surfaces 50, 52, 150, 152, 250, 252, 254, 350 and 354. The invention will be better understood with reference to the following detailed description.

Legs

Figure 5:
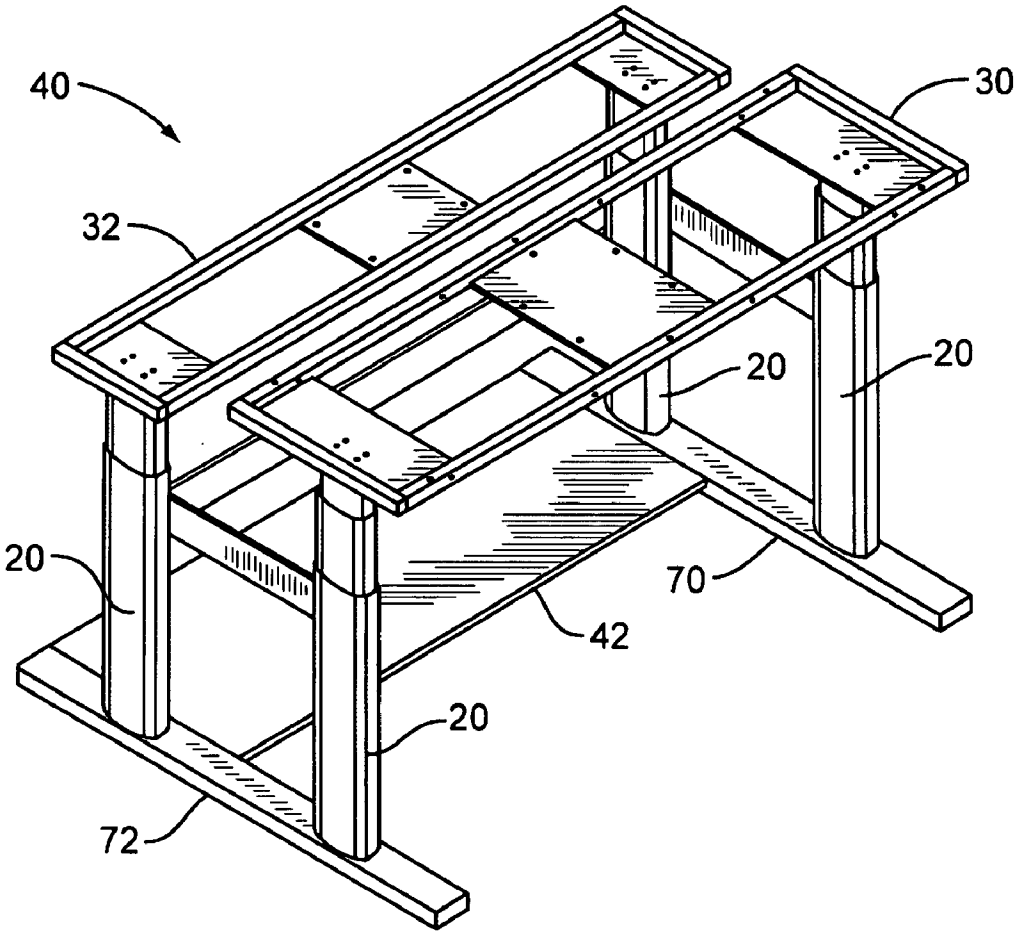
FIG. 5 is a schematic illustration of a base 40 that can be used to form the desk shown 110 in FIG. 4. The base 40 includes front and back pairs of actuator legs 20, each with top and bottom ends. Each pair of legs 20 is attached, at their respective top ends, to separate sub-surfaces 30, 32. The sub-surfaces 30, 32 are used to attach the rectangular desk top surfaces 150, 152 shown in FIG. 4. Each individual leg 20 in each pair is substantially parallel to the other leg 20 in that pair. As shown in the illustration, the bottom ends of the front legs 20 are attached to the bottom ends of the back legs 20 by means of a bar 70, 72 that lies underneath the legs 20, and is perpendicular to the legs 20. The left and right pairs of legs 20 are attached by means of a connecting means 42 attached to each of the perpendicular bars 70, 72.
Figure 7:
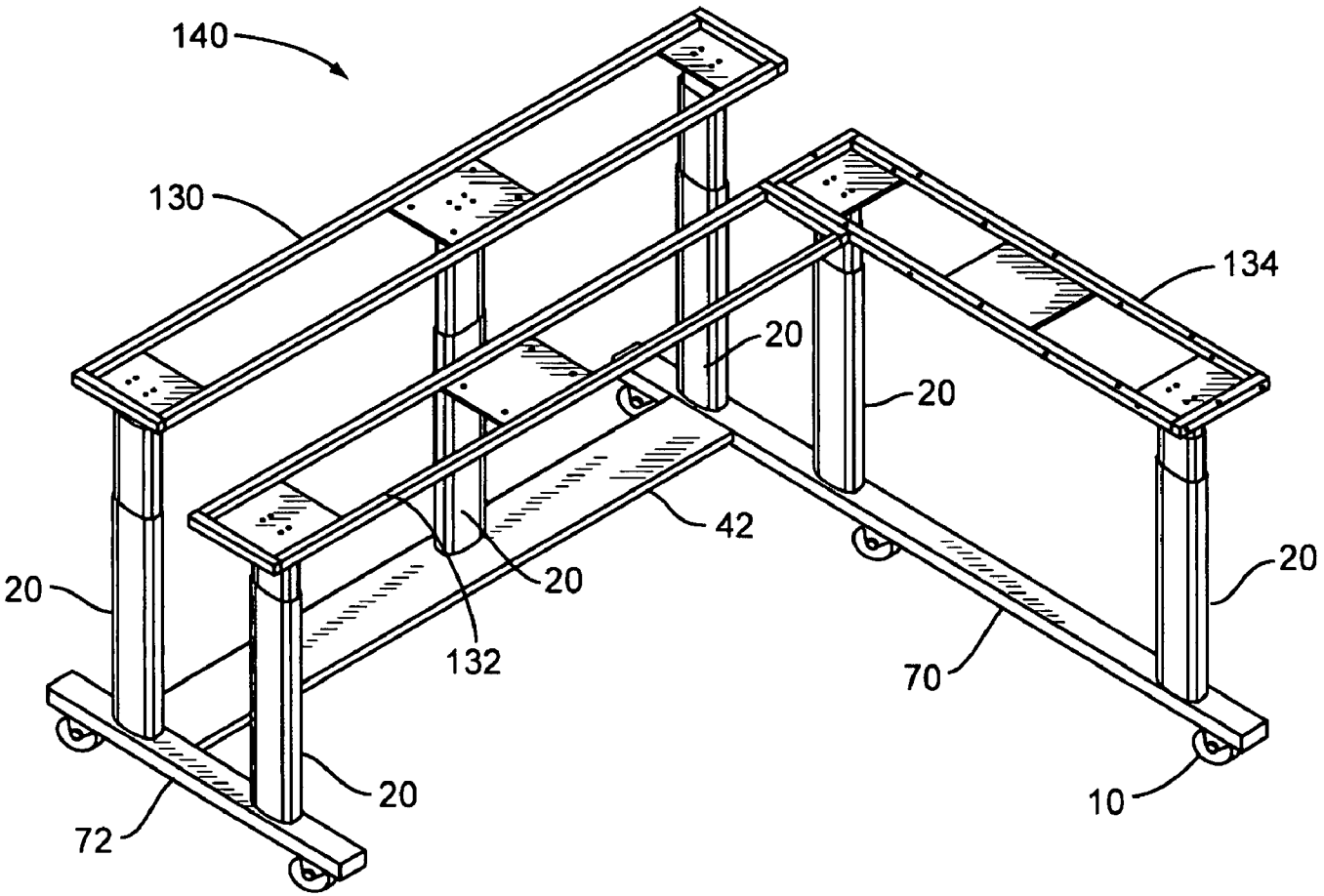
FIG. 7 is a schematic illustration of a frame portion 140 of the desk 120 of shown in FIG. 7, and shows the first, second and third sub-surfaces 130, 132, 134, as well as the various points of attachment of the legs 20 to the sub-surfaces 132, 134.
Figure 8:
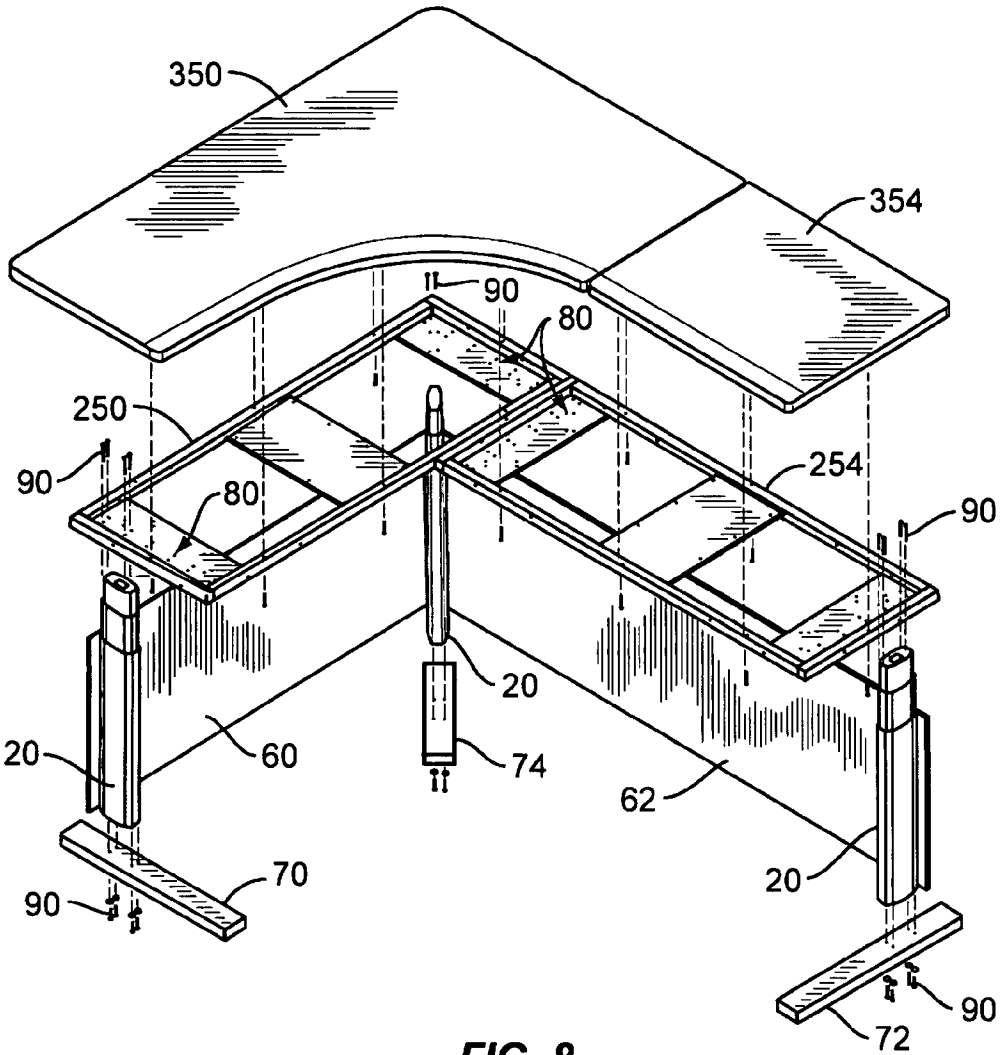
FIG. 8 is a schematic illustration of a table 220 with a curved top surface 356 that includes a first top surface portion 350 and a second top surface portion 354. The table 220 includes three legs 20, each of which includes a top end and a bottom end. The bottom end of each leg 20 is attached to a single bar 70, 72 or 74, which lies perpendicular to the legs 20, using the pin configuration 90 and screw-based attachment shown. The top end of each leg 20 is attached, using the pin configurations 90 shown, to a sub-surface 230 or 234. As shown, two rectangular sub-surfaces 230, 234 are joined to form a single L-shaped sub-surface element 236. This L-shaped sub-surface element 236 is attached, using the pin configurations 90 shown, to the table top 350, 354. In this figure, the base 240 of the table 220 is not attached to any casters.
Figure 9:
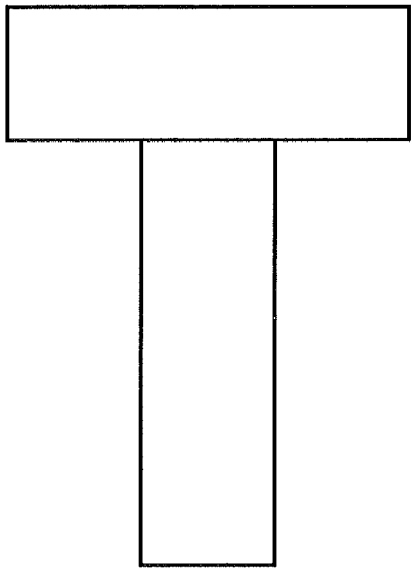
FIG. 9 is a schematic illustration of the table in a T-shaped configuration.

In the embodiments of the device described herein, there are multiple legs 20, such as, for example, three, four and six legs 20. When the legs 20 include raising and lowering means, for example, an actuator, the legs 20 must be maintained in substantially parallel orientation. That is, as shown in FIGS. 5, 7 and 8, each leg 20 that is attached to a single sub-surface 30, 32, 130, 132, 134, 230 or 234, which in turn is attached to a top surface 50, 52, 150, 152, 250, 252, 254, 350 and 354, must be free to move up and down, and the actuators that control the legs 20 cannot freely operate if they legs 20 are not parallel, as this would put strain on the actuators. Thus, the term "substantially parallel" is measured in terms of how parallel the legs 20 must be in order to be simultaneously raised and lowered in order to raise and lower the top surface 50, 52, 150, 152, 250, 252, 254, 350 and/or 354 to which they are (directly or indirectly) attached.

The legs 20 include a top end and a bottom end, and a front face and a back face. As shown in FIGS. 4-8, the bottom ends of the legs 20 are attached to one or more bases 70, 72 and 74 or joining means 42. As shown in FIGS. 5, 7, and 8, the top ends of the legs 20 is are attached to one or more sub-surfaces 30, 32, 130, 132, 134, 230 or 234, with the proviso that no one leg 20 is attached to more than one sub-surface 30, 32, 130, 132, 134, 230 or 234. The bases 70, 72 and 74 and joining means 42 function and sub-surfaces 30, 32, 130, 132, 134, 230 and 234 function to keep the legs 20 in substantially parallel orientation.

The legs 20 can be made of any material, provided that, when they are raised and lowered, they are compatible with the actuator that is used. For example, the legs 20 can be wooden, metallic, plastic, and combinations thereof. The legs 20 are provided with a means for attachment to both the base 70, 72 or 74 or joining means 42 and the sub-surface 30, 32, 130, 132, 134, 230 or 234. This attachment can be, but is not limited to, screws, nuts, and bolts. One example of a suitable leg 20 with an actuator means are any of the actuator columns provided by LINAK™. These actuator columns are described in U.S. Pat. No. 7,066,041; U.S. Pat. No. 7,047,834, U.S. Pat. No. 6,770,006, U.S. Pat. No. 6,739,004; and U.S. Pat. No. 6,158,295, the contents of which are hereby incorporated by reference in their entirety.

Bases

As shown in FIGS. 4-8, each of the bases 70, 72 and 74 can be a substantially flat piece, or can include shape, such as splayed legs. The only limitation to the shape of the base 70, 72 or 74, or materials used to form the base 70, 72 or 74, is that it must be able to be attached to one or more legs 20, and the base 70, 72 or 74 or combinations thereof must be able to maintain the legs 20 in substantially parallel orientation.

In some embodiments, raising and lowering the leg(s) 20 in a direction other than straight up and down may be desired, although typically, the legs 20 will be raised and lowered in a direction perpendicular to the floor on which the device is used. Either approach can be used, provided that the legs 20 remain parallel to each other.

Figure 2:
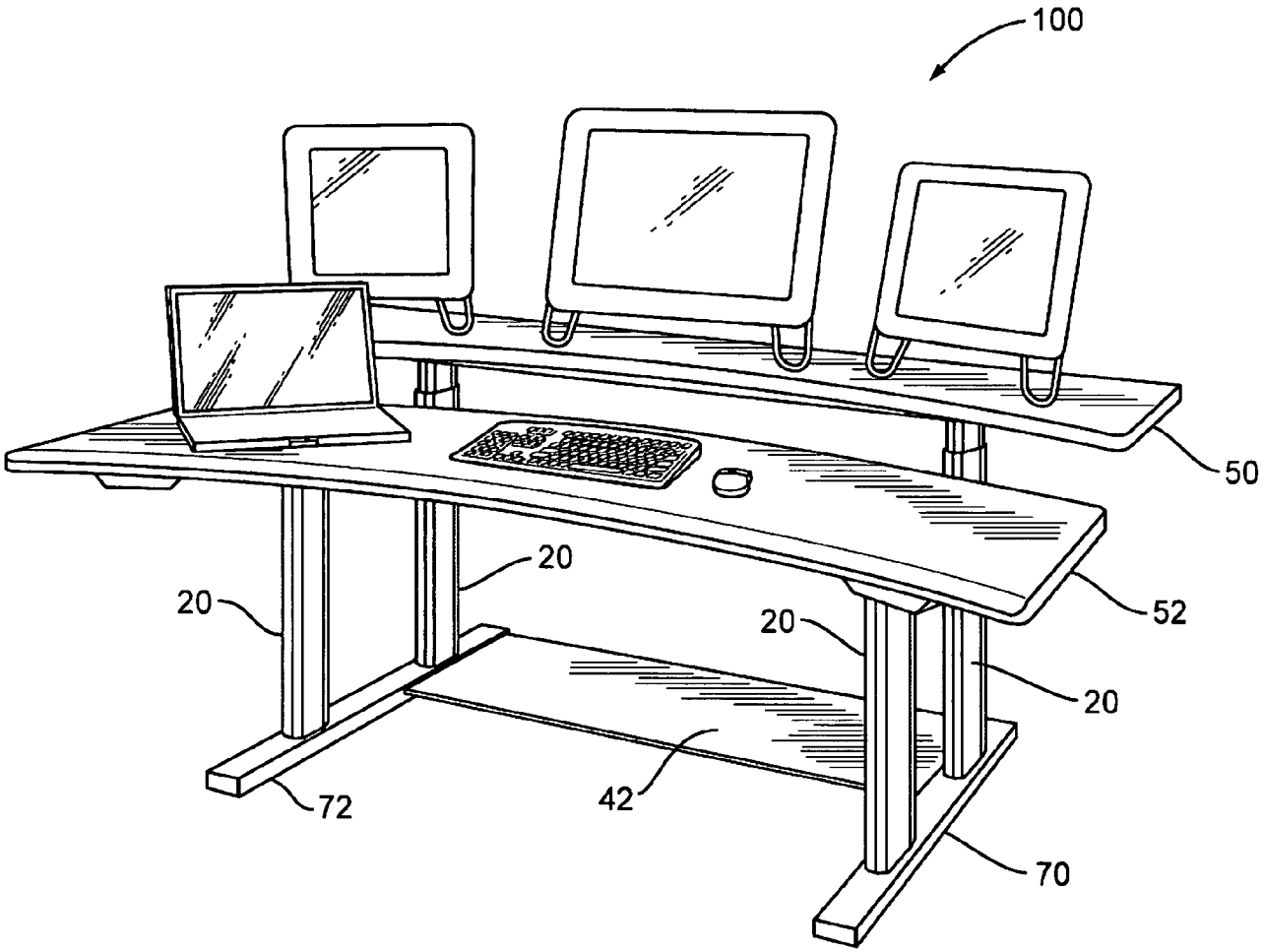
FIG. 2 shows a desk 100 with front and back pairs of actuator legs 20, each pair of which is attached to separate convex desk top surfaces 50, 52, and each individual leg 20 in each pair is substantially parallel to the other leg 20 in that pair. As shown in the drawing, the front and back pairs are raised to different heights. The front legs 20 are attached to the back legs 20 by means of a bar 70, 72 that lies underneath the legs 20, and is perpendicular to the legs 20. The left and right pairs of legs 20 are attached by means of a connecting means 42 attached to each perpendicular bar 70, 72.
Figure 4:
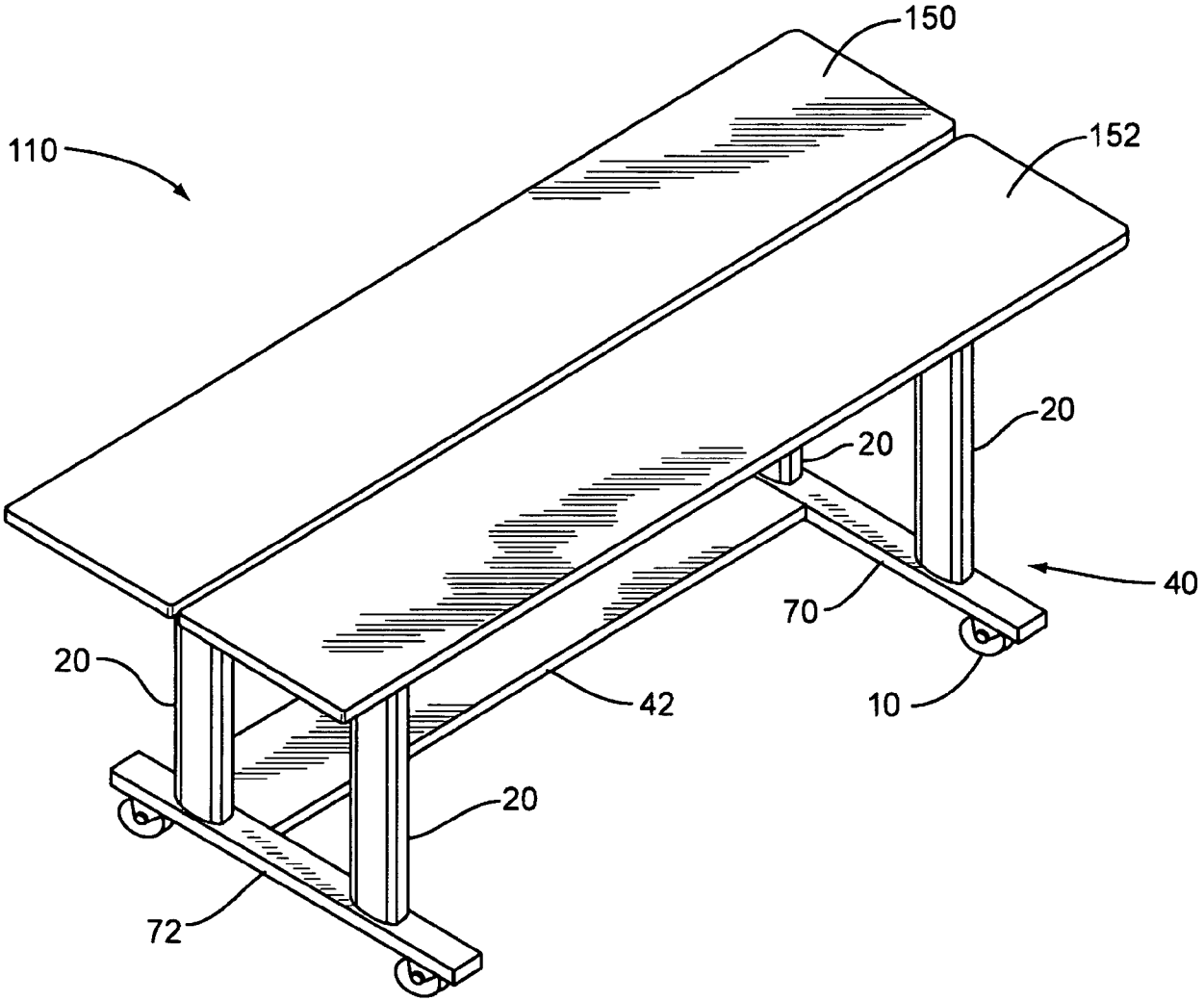
FIG. 4 is a schematic illustration of a desk 110 with front and back pairs of actuator legs 20, each pair of which is attached to separate rectangular desk top surfaces 150, 152 by means of a sub-surface (not shown). Each individual leg 20 in each pair is substantially parallel to the other leg 20 in that pair. As shown in the illustration, the front legs 20 are attached to the back legs 20 by means of a bar 70, 72 that lies underneath the legs 20, and is perpendicular to the legs 20. The left and right pairs of legs 20 are attached by means of a connecting means 42 attached to each perpendicular bar 70, 72. This connecting means 42 acts as a stabilizing element, stabilizing the desk 110 from racking, and thus helping to maintain the legs 20 in substantially parallel orientation. The perpendicular bars 70, 72 also are attached to four casters 10, one at each corner, which provides the table 110 with the ability to be easily moved.
Figure 6:
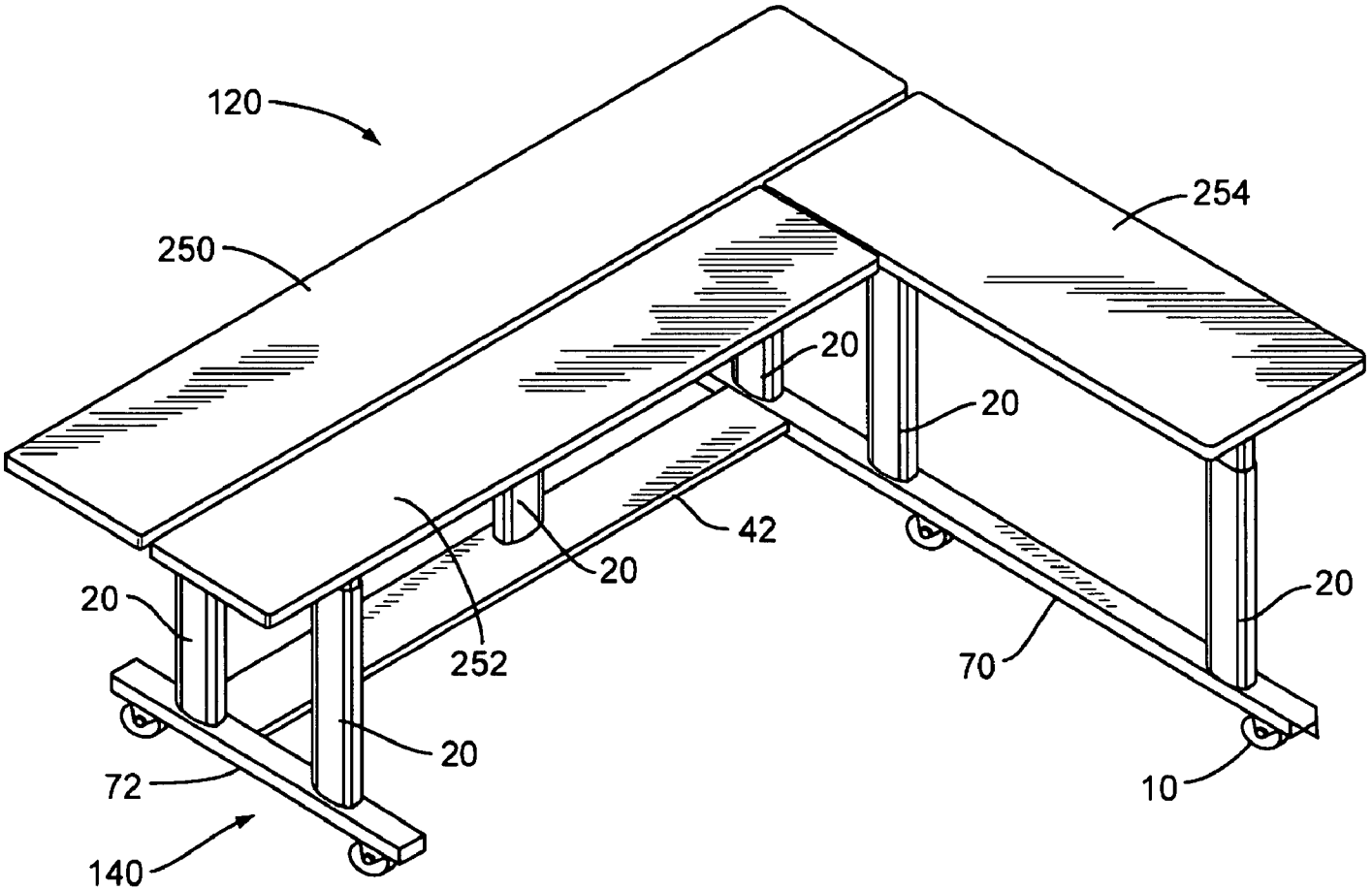
FIG. 6 is a schematic illustration of a table 120 with an L-shaped configuration, showing a plurality of actuator legs 20, each with top and bottom ends. Three of the legs 20 are attached, at their respective top ends, to a first sub-surface (not shown), which is attached to a first desktop surface 250. Two of the legs 20 are attached to a second sub-surface 254, and the final leg 20 is attached to a third sub-surface (not shown). The second and third sub-surfaces are attached in such a manner that both form a single sub-surface which can be raised at one time, and this single subsurface is attached to a desktop surface 252, 254. Thus, the desktop surface 252, 254 attached to this single subsurface has an L-shaped configuration, the whole of which can be raised or lowered separate from the desktop surface 250 attached to the first sub-surface. Each individual leg 20 attached to each subsurface is substantially parallel to the other legs 20 attached to that subsurface, although not all legs 20 are oriented in the same direction, in that the front face of one of the legs 20 is turned ninety degrees from the front faces of the other legs 20. As shown in the illustration, the bottom ends of three of the legs 20 are attached to a single bar 70 that lies underneath the legs 20, and is perpendicular to the legs 20. Two of the legs 20 are attached to a second bar 72, which also lies perpendicular to the legs 20. The first and second perpendicular bars 70, 72, which lie perpendicular to the legs 20, lie parallel to each other. The final leg 20 is attached to a connecting means 42, which joins together the first and second perpendicular bars 70, 72. This third perpendicular bar 42 lies perpendicular to the first and second perpendicular bars 70, 72, maintaining the first and second bars 70, 72 in parallel orientation to each other. The first and second perpendicular bars 70, 72 are attached to four casters 10, which provide the table 120 with the ability to be easily moved.

As shown in FIGS. 2, 4 and 6, in some embodiments, two or more sets of legs 20 are attached (indirectly) to two or more top surfaces 50, 52, 150, 152, 250, 252, 254, 350 or 354, which each raise and lower independent of one another. In such embodiments, the sets of legs 20 can be attached to one or more bases 70, 72 or 74 or joining means 42, in any orientation that permits each of the legs 20 that raise each top surface 50, 52, 150, 152, 250, 252, 254, 350 or 354 to remain parallel to one another.

As shown in FIGS. 2 and 4-7, the bases 70, 72 and 74 can be joined using a joining means 42, which can be any means that provides sufficient stability to adhere the bases 70, 72 and 74 together. To receive the joining means 42, the bases 70, 72 and 74 can include attachment means (such as threaded holes and/or exposed screw threads) to receive the joining means 42, or the joining means 42 can be attached using means such as adhesives, welding, brazing, and the like.

In those embodiments where multiple bases 70, 72 or 74 are used, the bases 70, 72 and 74 need not be aligned in any particular configuration, so long as the legs 20 that raise and lower each top surface 50, 52, 150, 152, 250, 252, 254, 350 or 354 remain parallel to one another.

Joining Means for Attaching the Bases

The joining means 42 for attaching the bases 70, 72 or 74 together can be any means that can physically attach the bases 70, 72 and 74. It can be present, for example, in a horizontal or vertical position, and serves to provide additional support and structure to the device, which helps keep the legs 20 in substantially parallel orientation. In those embodiments where the means 42 for attaching the bases 70, 72 and 74 is attached to each base 70, 72 and 74 using mechanical means, such as screws, bolts or nuts, the means 42 can include threaded holes and/or exposed screw threads. However, in other embodiments, the means 42 is attached to the bases 70, 72 and 74 using more permanent means, such as welding, brazing, and the like.

The joining means 42 can also be formed of any suitable material that helps maintain the physical structure of the device, including wood, metal, plastic and the like. As shown in FIG. 8, a joining means 60, 62 can also indirectly attach the bases 70, 72 and 74, by virtue of being directly attached to the legs 20 themselves.

Sub-Surfaces

The sub-surfaces 30, 32, 130, 132, 134, 230 and 234 function to provide the device with flexibility in terms of the types and positioning of the top surfaces 50, 52, 150, 152, 250, 252, 254, 350 and 354 and the legs 20. They can be engineered to include appropriate attachment means for both the legs 20 and top surfaces 50, 52, 150, 152, 250, 252, 254, 350 and 354. In some embodiments, the sub-surfaces 30, 32, 130, 132, 134, 250 and 254 include means for attaching the legs 20 and/or top surfaces 50, 52, 150, 152, 250, 252, 254, 350 and 354 in more than one configuration, which provides additional flexibility should the user's needs change over time.

As best shown in FIG. 1, a subsurface 30 can be prepared with leg attachment holes 80, top surface mounting holes 82 and subsurface connection holes 84 arranged in pre-determined hole patterns (such as hole patterns 80*a*, 80*b* and 80*c* for leg attachment holes 80 as shown in FIG. 1, for example) which permit modularity, providing different orientations of the legs 20 and/or top surfaces 50, 52, 150, 152, 250, 252, 254, 350 and 354 like those shown in FIGS. 2 and 4-8. As shown in FIGS. 5, 7 and 8, for example, the legs 20 can be attached at various positions along the sub-surfaces 30, 32, 130, 132, 134, 230 or 234 (such as near the ends or near the middle), and the top surfaces 50, 52, 150, 152, 250, 252, 254, 350 and 354 can be aligned in various positions as well.

In some embodiments like the embodiment shown in FIGS. 4 and 5, for example, a single sub-surface 30, 32 is attached to a single leg 20 or multiple legs 20, and the sub-surface 30, 32 is attached to a single top surface 150, 152. The novel feature of this embodiment is that, with judicious selection of attachment means (such as screw holes), the top surface 150 or 152 can be attached in a variety of orientations, and a single sub-surface 30 or 32 can accommodate a variety of top surfaces 50 or 52.

In embodiments like those shown in FIGS. 7 and 8, a plurality of sub-surfaces 132 and 134 or 230 and 234 are joined utilizing holes 84 to form a single, joined sub-surface, where the shape that is formed requires the attachment of a plurality of legs 20. For example, as shown in FIGS. 6 and 8, the joined sub-surface can be in an L-shaped configuration, and can accommodate top surfaces 252, 254, 350 and 354 that have these and/or other shapes.

In embodiments like those shown in FIGS. 2-5, the device includes two sub-surfaces 30, 32, each of which is attached to one or more legs 20, and also to its own top surface 50, 52, 150 or 152. In these embodiments, one or both of the top surfaces 50, 52, 150 and 152 can be raised or lowered by virtue of being attached, through a sub-surface 30, 32, to legs 20 with actuator means, and one of the top surfaces 50, 52, 150 and 152 can be locked into a specific configuration, by virtue of being attached, through the sub-surface 30 or 32, to legs 20 that lack an actuator means. The legs 20 that are locked in a specific configuration need not be parallel to each other.

The sub-surface 30, 32, 130, 132, 134, 250 or 254 is ideally formed from a rigid material, such as metal, including HRS, stainless steel, aluminum, and the like, wood, plywood, medium density fiberboard, and the like, but ideally is made from steel, such as steel tubing with attached steel mounting plates. In one embodiment, the steel tubing is at least an inch in diameter, and the mounting plates are at least a quarter inch in thickness.

The sub-surface member 30, 32, 130, 132, 134, 250 or 254 can have virtually any desired shape, and examples of suitable shapes include square, rectangular, triangular, trapezoidal, circular, elliptical, L-shaped and T-shaped shapes.

The sub-surface member 30, 32, 130, 132, 134, 250 or 254 can be engineered, for example, using CAD-CAM devices, to have a series of screw holes 80 for attachment to both the top surface 50, 52, 150, 152, 250, 252, 254, 350 or 354 and the leg(s) 20.

Top Surfaces

The top surfaces 50, 52, 150, 152, 250, 252, 254, 350 and 354 can be any suitable top surface used in desks or other pieces of furniture that might take advantage of one or more raising/lowering elements. The top surfaces 50, 52, 150, 152, 250, 252, 254, 350 and 354 can either include a means for attaching to the sub-surface 30, 32, 130, 132, 134, 230 or 234, such as screws, nuts, bolts, and the like, or can be permanently adhered using adhesives and the like. One aspect of the invention is that the devices can be modified to suit the individual needs of the end-user, temporary attachment means, such as screws, nails, brads, nuts, bolts, hook and loop attachments, and the like, are preferred.

Representative materials suitable for use in preparing the top surfaces 50, 52, 150, 152, 250, 252, 254, 350 and 354 include, but are not limited to, padded surfaces, glass, metal, CORIAN®, SILESTONE®, marble, granite, concrete, vinyl-coated medium density fiberboard, high-pressure laminated particle board, wood, or combinations thereof. As shown in FIGS. 2, 4, 6 and 8, for example, some devices include two or more top surfaces 50, 52, 150, 152, 250, 252, 254, 350 and 354, in which case, combinations of these surfaces can be used.

Representative Devices

In one aspect, two or more of the legs 20 are capable of being raised and lowered in series, such that an attached top surface 52, 150, 152, 250, 252, 254, 350 or 354 can be raised or lowered. As shown in FIG. 2, for example, two or more such top surfaces 50, 52 can be raised and lowered to different heights, which can provide advantages in certain applications. For example, when used as a desk 100, a keyboard and/or mouse can be provided at a certain height, and a monitor at another height, to provide the user(s) with a custom fit, ergonomically correct workspace.

In the embodiment shown in FIG. 2, the plurality of legs 20 can either maintain the second top surface 50 or 52 at a constant height, or can raise and lower the second top surface 50 or 52 independent of the first top surface 50 or 52. Where the plurality of legs 20 maintains the second top surface 50 or 52 at a constant height, the legs 20 can be, but need not be, substantially parallel to one another. Where the plurality of legs 20 can raise and lower the second top surface 50 or 52, this can provide the user with the ability to raise and lower the height of a desk 100, for example, to fine-tune the position of a keyboard and/or mouse, and also to raise and/or lower a monitor.

Using the various aspects of the invention, ergonomic workstations can be created, which can raise and lower various portions of a desktop to provide a custom fit, ergonomically correct workstation. The configurations are not limited to any given shape, but rather, by judicious positioning of the various legs, can be formed into any desired configuration. Representative configurations include square, triangular, circular, elliptical, trapezoidal, and T-shaped configurations.

FIG. 1 shows the modular configuration of a subsurface frame or table frame 30. The hole pattern 80 allows the frame 30 to be modular, providing hole patterns 80 to be used in several furniture configurations. The frame 30 can be turned at different angles providing mounting surfaces for various leg actuators 20. As shown in FIGS. 7 and 8, subsurface frames 130 and 132 or 230 and 234 can be bolted together to form various shapes.

FIG. 2 shows a combination of four leg column actuators 20 designed to lift two work surfaces 50, 52 independently of each other. The concave curvature with a waterfall edge provides an increase level of ergonomic quality. This application lends itself to multiple monitor usage.

Figure 3:
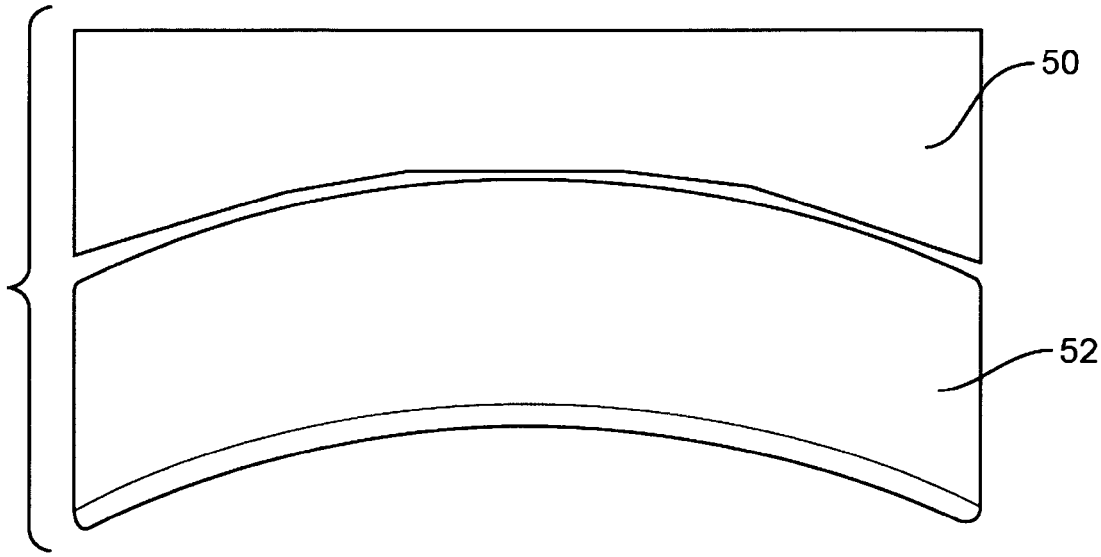
FIG. 3 is a schematic illustration of a table top with two independent concave portions 50, 52, which can be attached to the desk 100 shown in FIG. 2.

FIG. 3 shows the concave shape of the multi use top 50, 52 shown in FIG. 2. The size allows for multiple monitors as well as peripheral equipment.

FIG. 4 shows the options for multiple monitors and peripheral support casters (10) add mobility to the work environment.

FIG. 5 is the base 40 of the table 100 shown in FIG. 2. Four actuator column legs (20) drive the table frames or subframes (30, 32) up and down. This function allows the operator to go from a sitting position to a standing height. The bottom framework (40) as well as the subframes 30, 32 insures that the columns 20 are parallel, preventing a binding motion as they extend in length.

FIGS. 6 and 7 show the ability of modular table frames 130, 132 and 134 (which are substantially similar to the frame 30 shown in FIG. 1) to be configured in such a way to not only provide dual work surface adjustability, but to also provide an arrangement to support a return surface 254 for added work flexibility. FIG. 7 shows casters (10), actuator column legs (20), table frame/subframes (130, 132 and 134), and a bottom framework (140) that are substantially similar to the corresponding components shown in FIG. 5, but in a different configuration. As shown in FIG. 7, the end of one subsurface frame 132 can be joined to a side edge of another subsurface frame 134 by means of bolts extending through holes 84 to form a L-shaped frame.

FIG. 8 shows an exploded view of a work surface (356), subsurface or table frame (236), and modesty panels (60), and the positions of actuator leg columns (20) and support feet (70, 72 and 74). The picture shows the modularity of the table frames 230, 234 being used to support the correct footprint for the work surface 350, 354, in this embodiment, using preselected screw hole patterns (80) designed to align screw holes with screws (90) that go from the subsurfaces (230, 234) into the leg columns (20), from the subsurface 230, 234 into the work surface 350, 354, and from the support feet (70, 72 and 74) into the actuator leg columns (20). As shown in FIG. 8, the multiple hole patterns 80 in the subsurfaces 230, 234 permit the top ends of the actuator legs 20 to be mounted to the subsurfaces 230, 234 such that each leg 20 is either square with an edge of a subsurface 230 or 234 or is aligned at an acute angle with an edge of a subsurface 230 or 234. As also shown in FIGS. 5, 7 and 8, the multiple hole patterns 80 in the subsurfaces 30, 32, 130, 132, 134, 230 and 234 also permit the top end of an actuator leg 20 to be mounted to a subsurface 30, 32, 130, 132, 134, 230 or 234 at any one of a plurality of different locations on the subsurface 30, 32, 130, 132, 134, 230 or 234.

What is claimed is:

1. A modular table or workstation comprising:

a. at least one subsurface frame member including a first pattern of holes therein and a second pattern of holes therein;

b. at least one leg having a side and an upper end configured for attachment to the subsurface frame member; and c. a substantially planar top configured to be mounted on and attached to the subsurface frame member;

d. wherein the first pattern of holes is arranged to permit the upper end of the leg to be attached to the subsurface frame member in a first orientation, and the second pattern of holes is arranged to permit the upper end of the leg to be attached to the subsurface frame member in a second orientation that is different from the first orientation;

e. a second subsurface frame member having a third plurality of holes therein and a fourth plurality of holes therein, wherein the third plurality of holes is arranged to facilitate connection of the second subsurface frame member to the at least one subsurface frame member in a first configuration, and the fourth plurality of holes is arranged to facilitate connection of the second subsurface frame member to the at least one subsurface frame member in a second configuration that is different from the first configuration; and f. wherein the at least one subsurface frame member and the second subsurface frame member combine to form one shape in the first configuration and combine to form another shape in the second configuration.

2. The workstation of claim 1 wherein the at least one subsurface frame member has an outer edge and in the first orientation, the side of the leg is substantially parallel to the outer edge, and in the second orientation, the side of the leg is not parallel to the outer edge.

3. The workstation of claim 1 wherein the first pattern of holes and the second pattern of holes each include four holes arranged in a rectangular pattern.

4. The workstation of claim 1 further comprising a second leg having a second upper end, wherein the second subsurface frame member includes a fifth pattern of holes therein and a sixth pattern of holes therein, wherein the fifth pattern of holes permits the second upper end of the second leg to be attached to the second subsurface frame member in a first arrangement, and wherein the sixth pattern of holes permits the second upper end of the second leg to be attached to the subsurface frame member in a second arrangement that is different from the first arrangement.

5. The workstation of claim 1 wherein the second orientation that is different from the first orientation in at least one of relative location and relative angle.

6. A modular table or workstation comprising:

a. at least one subsurface frame member including a first pattern of holes therein and a second pattern of holes therein;

b. at least one leg having a side and an upper end configured for attachment to the subsurface frame member;

c. a substantially planar top configured to be mounted on and attached to the subsurface frame member;

d. wherein the first pattern of holes is arranged to permit the upper end of the leg to be attached to the subsurface frame member in a first orientation, and the second pattern of holes is arranged to permit the upper end of the leg to be attached to the subsurface frame member in a second orientation that is different from the first orientation; and e. wherein the subsurface frame member further comprises a third pattern of holes therein arranged to permit the top to be attached to the subsurface frame member.

7. A modular table or workstation comprising:

a. a first subsurface frame member configured to support a first work surface;

b. a second subsurface member configured to support a second work surface;

c. a first plurality of legs;

d. a second plurality of legs;

e. a first top mounted on and attached to the first subsurface frame member;

f. a second top mounted on and attached to the second subsurface frame member;

g. wherein the first subsurface frame member is configured to permit the first plurality of legs to be attached to the first subsurface frame member in at least two different configurations;

h. wherein the second subsurface frame member is configured to permit the second plurality of legs to be attached to the second subsurface frame member in at least two different configurations; and i. wherein the first subsurface frame member is configured to permit the first top to be attached thereto and the second subsurface frame member is configured to permit the second top to be attached thereto.

8. The modular workstation of claim 7 wherein each of the first plurality of legs is variable in length such that a vertical distance between the first top and the second top can be selectively altered by extending or contracting the lengths of the first plurality of legs.

9. The modular workstation of claim 7 wherein the first subsurface frame member is connected to the second subsurface frame member and forms a subsurface frame assembly that is L-shaped.

10. The modular workstation of claim 7 wherein the first subsurface frame member is configured to permit the first plurality of legs to be attached to the first subsurface frame member in at least two different configurations that differ in at least one of location and angular orientation.

* * * * *